US010822152B2

(12) United States Patent
Kenney et al.

(10) Patent No.: US 10,822,152 B2
(45) Date of Patent: Nov. 3, 2020

(54) EXPANDABLE CORNER CUSHION FOR PROTECTING ARTICLES DURING TRANSPORTATION AND RELATED SYSTEMS AND METHODS

(71) Applicant: FEDEX CORPORATE SERVICES, INC., Collierville, TN (US)

(72) Inventors: Tyler Kenney, Memphis, TN (US); Evan Drake Edwards, Horn Lake, MS (US)

(73) Assignee: FEDEX CORPORATE SERVICES, INC., Collerville, TN (US)

( * ) Notice: Subject to any disclaimer, the term of this patent is extended or adjusted under 35 U.S.C. 154(b) by 580 days.

(21) Appl. No.: 15/442,169

(22) Filed: Feb. 24, 2017

(65) Prior Publication Data

US 2018/0244456 A1 Aug. 30, 2018

(51) Int. Cl.

*B65D 81/05* (2006.01)
*B65B 5/04* (2006.01)
*B65B 61/20* (2006.01)

(52) U.S. Cl.

CPC ..... *B65D 81/057* (2013.01); *B65D 2581/055* (2013.01)

(58) Field of Classification Search

CPC ..... B65D 81/057
See application file for complete search history.

(56) References Cited

U.S. PATENT DOCUMENTS

| | | | | |
|---|---|---|---|---|
| 3,695,421 | A * | 10/1972 | Wood | B65D 81/057 206/523 |
| 4,063,702 | A * | 12/1977 | Wilde | A47B 95/043 248/345.1 |
| 5,769,233 | A * | 6/1998 | Fredriks | B65D 81/054 206/305 |
| 5,823,352 | A | 10/1998 | Mena et al. | |
| 6,311,844 | B1 | 11/2001 | Ridgeway et al. | |
| 6,629,608 | B2 | 10/2003 | Hurley et al. | |
| 8,196,747 | B2 | 6/2012 | Stegner et al. | |
| 2008/0179216 | A1* | 7/2008 | Kari | B65D 81/057 206/586 |

FOREIGN PATENT DOCUMENTS

| | | | | |
|---|---|---|---|---|
| EP | 2426068 | A1 * | 3/2012 | B65D 81/057 |
| GB | 1458872 | A * | 12/1976 | B65D 81/057 |

* cited by examiner

*Primary Examiner* — Hemant Desai
*Assistant Examiner* — Tanzim Imam
(74) *Attorney, Agent, or Firm* — Finnegan, Henderson, Farabow, Garrett & Dunner LLP

(57) ABSTRACT

A corner protector for protecting a corner of an article includes a first side panel lying in a first plane, and a second side panel lying in a second plane. The corner protector also includes an accordion-like connection structure interconnecting the first side panel and the second side panel such that inner surfaces of the first and second side panels define an adjustable article receiving cavity therebetween.

18 Claims, 8 Drawing Sheets

EXPANDABLE CORNER CUSHION FOR PROTECTING ARTICLES DURING TRANSPORTATION AND RELATED SYSTEMS AND METHODS

FIELD

The present application relates to an expandable packaging structure and related systems and methods, and in particular, to an expandable foam corner cushion for protecting articles, most preferably the corners of an article, while it is being transported. The disclosure includes systems and methods of using such corner protectors to package and protect articles and methods of making such corner protectors.

BACKGROUND

An article packaged and shipped in a shipping container often requires a protective packaging structure to cushion and support the article within the shipping container and protect the article from damage potentially caused by rough handling or other circumstances associated with transporting the article from one location to another. With many types of articles the corners of the articles or other protruding sections can be the most vulnerable to damage and require the greatest protection. Relatively flat articles and objects having the general shape of a rectangular solid may come in a large variety of different thicknesses, and include a pair of substantially planar, parallel side faces and intersecting, orthogonal end faces at their corners. Even when a manufacturer's package for these articles provides some protection for the article, that manufacturer's package is often inserted into an additional outer shipping container to provide additional protection when the articles are shipped by customers between locations, by plane, train, or truck, by means of example. In that circumstance, additional protection may be desired between the manufacturer's package and the outer shipping container, including protection between the outside corners of the manufacturer's package and the outer shipping container. In other circumstances an article to be transported does not include a manufacturer's package, but instead is placed into a shipping container, often with some form of protection between the corners of the article and the shipping container.

Examples of articles that are shipped in shipping containers and need to be protected include products such as artwork, televisions, windows, and furniture, and in some cases the original manufacturer boxes designed to hold the products. Such articles often include protruding portions or sections, often corners, that can be damaged, if not protected.

Many traditional corner protectors are designed to contact three intersecting faces at each of the eight corners of an article having the shape of a rectangular solid. One portion of such a traditional corner protector extends partially over one side face of the article at a corner of the article, and two intersecting orthogonal portions of the corner protector fit over two intersecting end walls at the corner of the article. When such traditional corner protectors are applied, a total of eight of the corner protectors are needed to protect the eight corners of the rectangular solid. Different rectangular solids having different thicknesses can be accommodated by the same eight corner protectors, with two corner protectors needed to extend partially over each of the two opposing parallel side faces and the intersecting, orthogonal end faces at each corner of the rectangular solid. The two corner protectors needed at each corner of an article in the shape of a rectangular solid would be spaced closer together for lesser thicknesses of the rectangular solid, and farther apart for greater thicknesses of the rectangular solid. Such traditional systems of packaging and protecting articles for transportation require at least eight corner protectors in total for each article and are cumbersome in application, thus requiring the use of many parts and significant time.

In an alternative, custom corner protectors could be sized and shaped to fit over the two opposing parallel side faces at each corner of the rectangular solid. However, a difficulty with providing corner protectors configured to fit over the two opposing parallel side faces at each corner of a protected product in the shape of a rectangular solid is that a large stock of corner protectors would be needed to fit products of various thicknesses. An incorrectly sized corner protector would either be difficult to fit to the protected product, strained because of being too tight, or easily dislodged because of being too loose. In the case of plastic foam corner protectors, for example, the tooling required to mold the large number of different sized protectors needed to accommodate a large variety of products having different thicknesses could also be prohibitively expensive.

In addition, traditional forms of corner protectors and systems for packaging articles for transportation often do not provide good protection of the corners, because forces applied during shipment to the outer corner protectors are transferred to the corners of the article being shipped. If the outer shipping container is dropped or bumped at the corner, or otherwise subjected to a force at one or more of its corners, that force may damage a corner of the article being shipped.

The packaging structure according to the present disclosure is directed towards overcoming one or more of the problems set forth above and/or other problems of the prior art.

SUMMARY

An aspect of the present disclosure is an expandable corner cushion that will, as an expandable unit, protect the four faces at each corner of an article to be shipped, and expand and contract to fit a range of widths, thereby conforming to the shape of the article's corner and grasping opposite faces of the article at each corner. The expandable corner cushion can be readily applied over the corners of the article to be shipped, and only four such corner cushions would be required to protect the corners of an article in the shape of a rectangular solid. The article with the four corner cushions attached can then be readily inserted in a shipping container.

In another aspect of the present disclosure, the expandable corner cushion is an expandable foam corner cushion that is expandable in one direction to accommodate a wide range of article sizes. One corner cushion can have universal application to a variety of articles having different sizes and configurations, and particularly articles in the shape of a rectangular solid of different thicknesses. The expandable design can be achieved by placing a series of cuts in portions of the corner cushion, and particularly interlaced cuts extending in from opposite sides of portions of the corner cushion and/or along central portions of the corner cushion, allowing the corner cushion to expand and contract in one direction, for example in the style of an accordion.

In yet another aspect of the present disclosure, the expandable corner cushion is made to have a void area at the corner, such that the corner of the article held within the corner cushion is spaced from the outer surface of the corner cushion. When the article with its four corners covered by four of the disclosed exemplary corner cushions is then fit within a shipping container, forces that might be applied during shipping to the corners of the outer shipping container and the corner cushions are not transferred directly to the corners of the article. The corner cushions according to the present disclosure thus provide a suspension effect for enhancing protection at the corners of the articles to be shipped.

A still further aspect of the present disclosure is directed to a corner protector for protecting a corner of an article. The corner protector includes a first side panel lying in a first plane, and a second side panel lying in a second plane. The corner protector also includes an accordion-like connection structure interconnecting the first side panel and the second side panel such that inner surfaces of the first and second side panels define an adjustable article receiving cavity therebetween.

Another aspect of the present disclosure is directed to a packaging structure for insertion between an outside corner of an article and a shipping container. The packaging structure includes a first side panel lying in a first plane, and a second side panel lying in a second plane parallel to the first plane. The packaging structure also includes a first end panel lying in a third plane perpendicular to the first and second planes, the first end panel having a first side portion interconnected with the first side panel and a second side portion interconnected with the second side panel, and a second end panel lying in a fourth plane perpendicular to the first, second, and third planes, the second end panel having a first side portion interconnected with the first side panel and a second side portion interconnected with the second side panel. Both the first end panel and the second end panel include one or more cuts extending into the respective end panels from outer edges of third and fourth side portions between the first and second side portions of the respective end panels to allow the end panels to expand and contract in an accordion-like manner in a direction substantially perpendicular to the first and second side panels. Inner surfaces of the first and second side panels and inner surfaces of the first and second end panels together define an adjustable cavity for receiving the outside corner of the article.

Yet another aspect of the present disclosure is directed to a method of fabricating a corner protector for protecting a corner of an article. The method includes forming first and second side panels and first and second end panels from a flexible, load-bearing plastic foam. The method also includes forming one or more slits extending into the first end panel and the second end panel from at least one of outer peripheral edges of first and second opposite and parallel side portions of the end panels and a central portion of the end panels in between the outer peripheral edges to allow the end panels to expand and contract in an accordion-like manner in a direction substantially parallel to the outer peripheral edges of the first and second side portions. The method further includes interconnecting a third side portion of the first end panel with the first side panel and a fourth side portion of the first end panel with the second side panel such that the first end panel is arranged substantially perpendicular to the first and second side panels, and interconnecting a third side portion of the second end panel with the first side panel and a fourth side portion of the second end panel with the second side panel such that the second end panel is arranged substantially perpendicular to the first end panel and the first and second side panels. The method of forming the corner protector results in the inner surfaces of the first and second side panels and the inner surfaces of the first and second end panels together defining a cavity with an adjustable distance between the inner surfaces of the first and second side panels for receiving the corner of the article, and the article may be one of a plurality of articles having different thicknesses.

DETAILED DESCRIPTION

Figure 1:
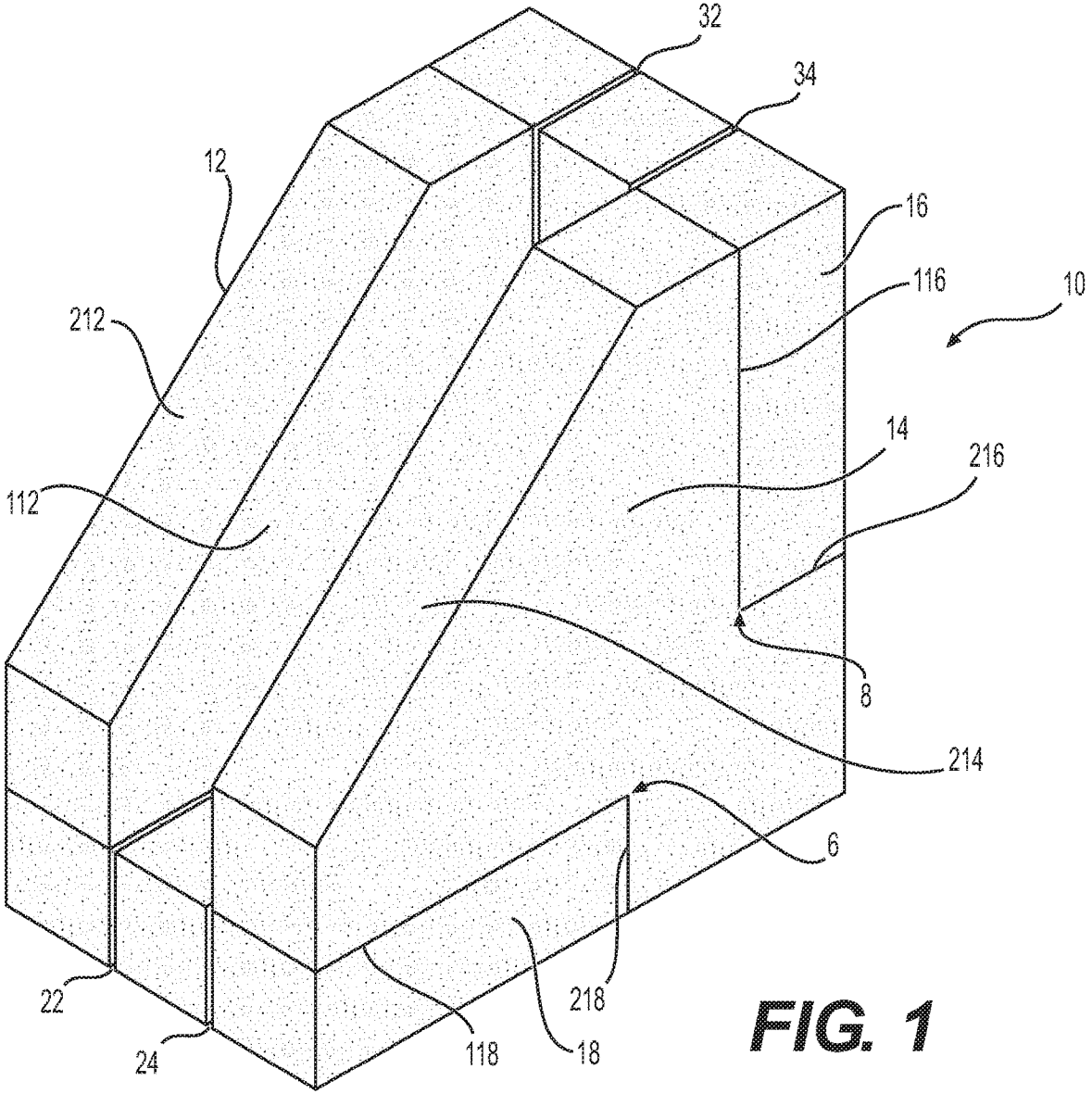
FIG. 1 is a perspective view of an exemplary embodiment of a corner protector according to this disclosure.
Figure 2:
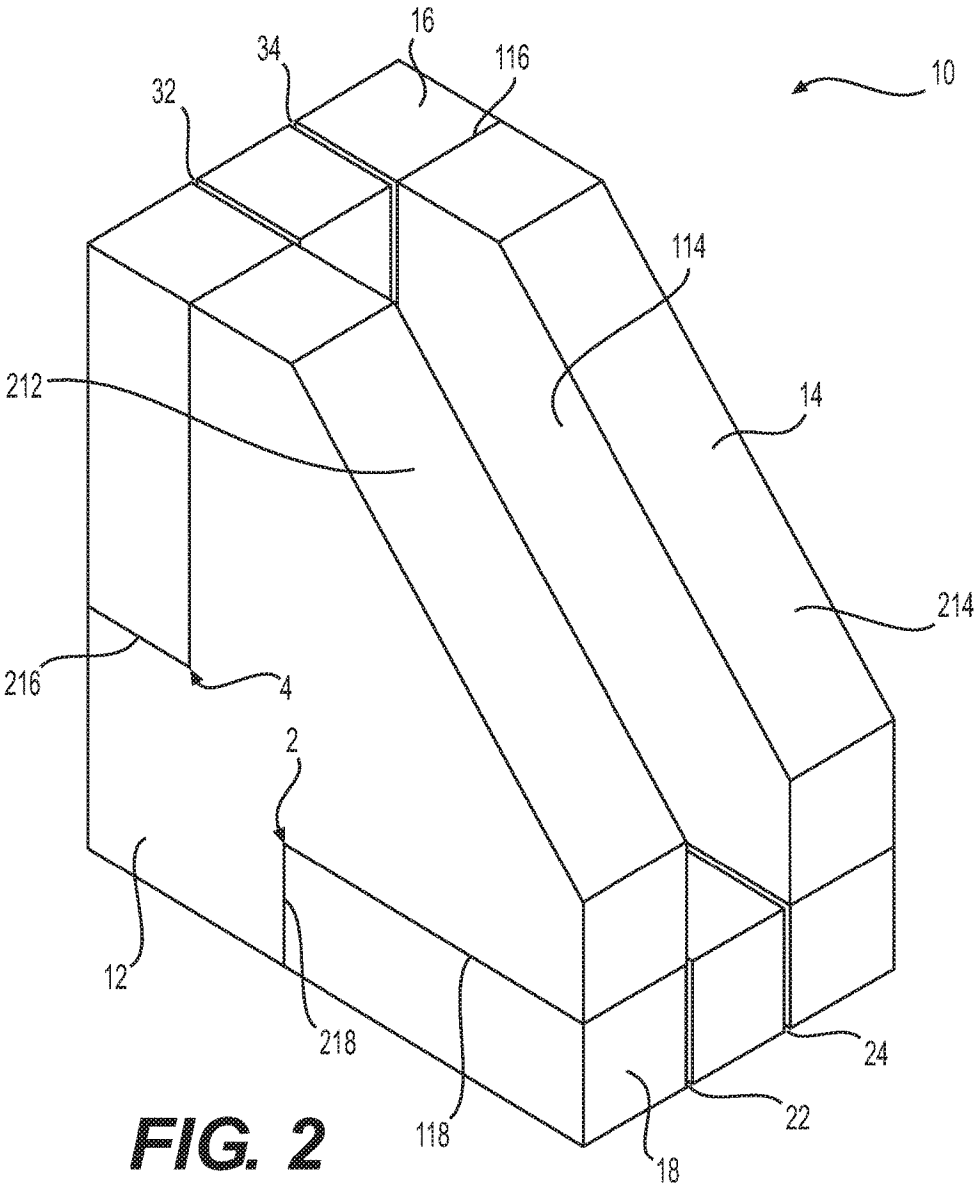
FIG. 2 is another perspective view from the opposite side of the exemplary embodiment of the corner protector shown in FIG. 1.
Figure 7:
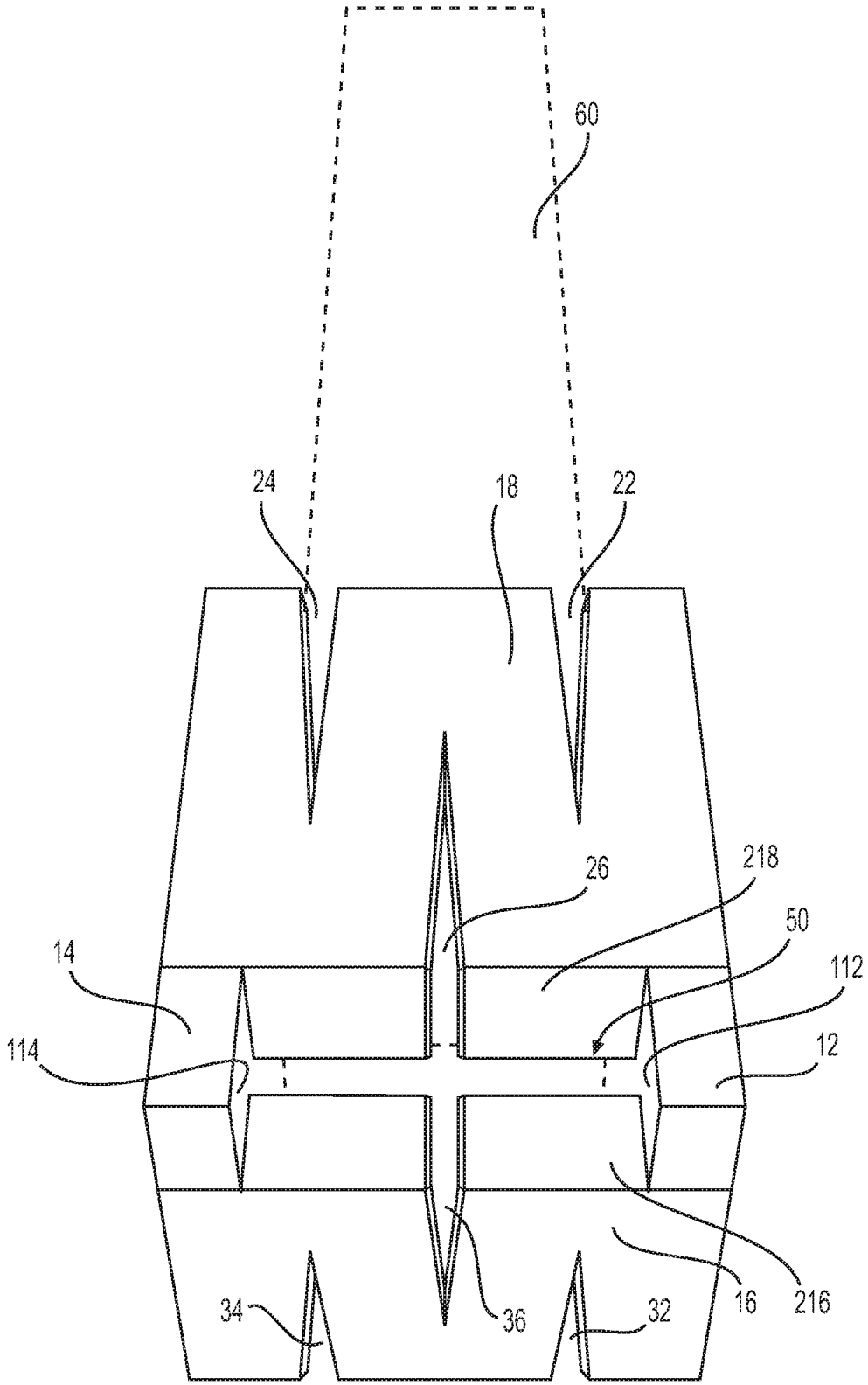
FIG. 7 is a perspective view of the exemplary embodiment of the corner protector shown in FIGS. 1 and 2 installed over the corner of an article.

FIGS. 1 and 2 depict one exemplary embodiment of a packaging structure in the form of a corner protector 10 for protecting a corner of an article. FIG. 7 shows the exemplary embodiment of the corner protector 10 depicted in FIGS. 1 and 2, flipped over and installed over an upper corner of an article 60.

Figure 3:
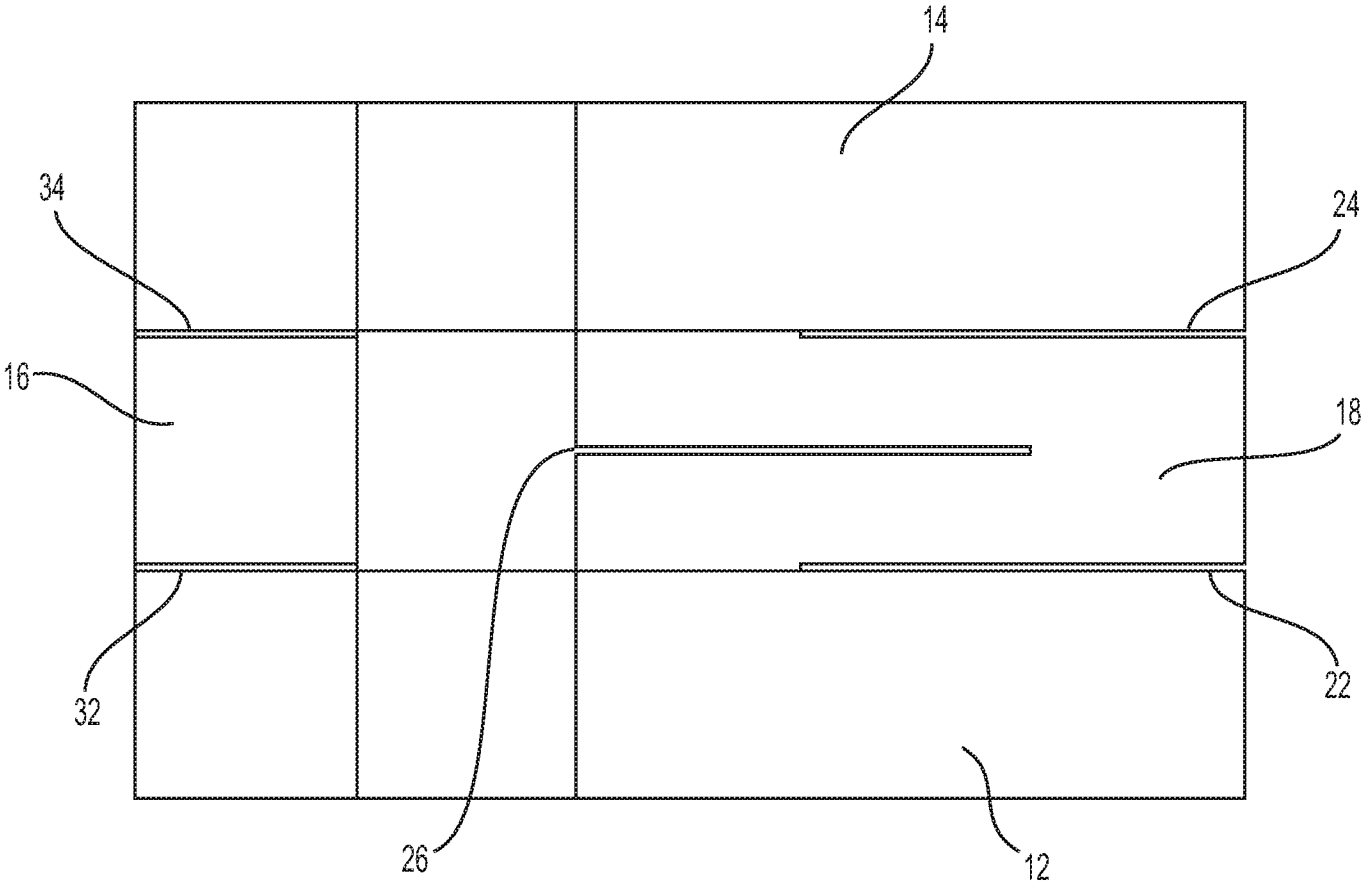
FIG. 3 is a top plan view of the exemplary embodiment of the corner protector shown in FIGS. 1 and 2.
Figure 4A:
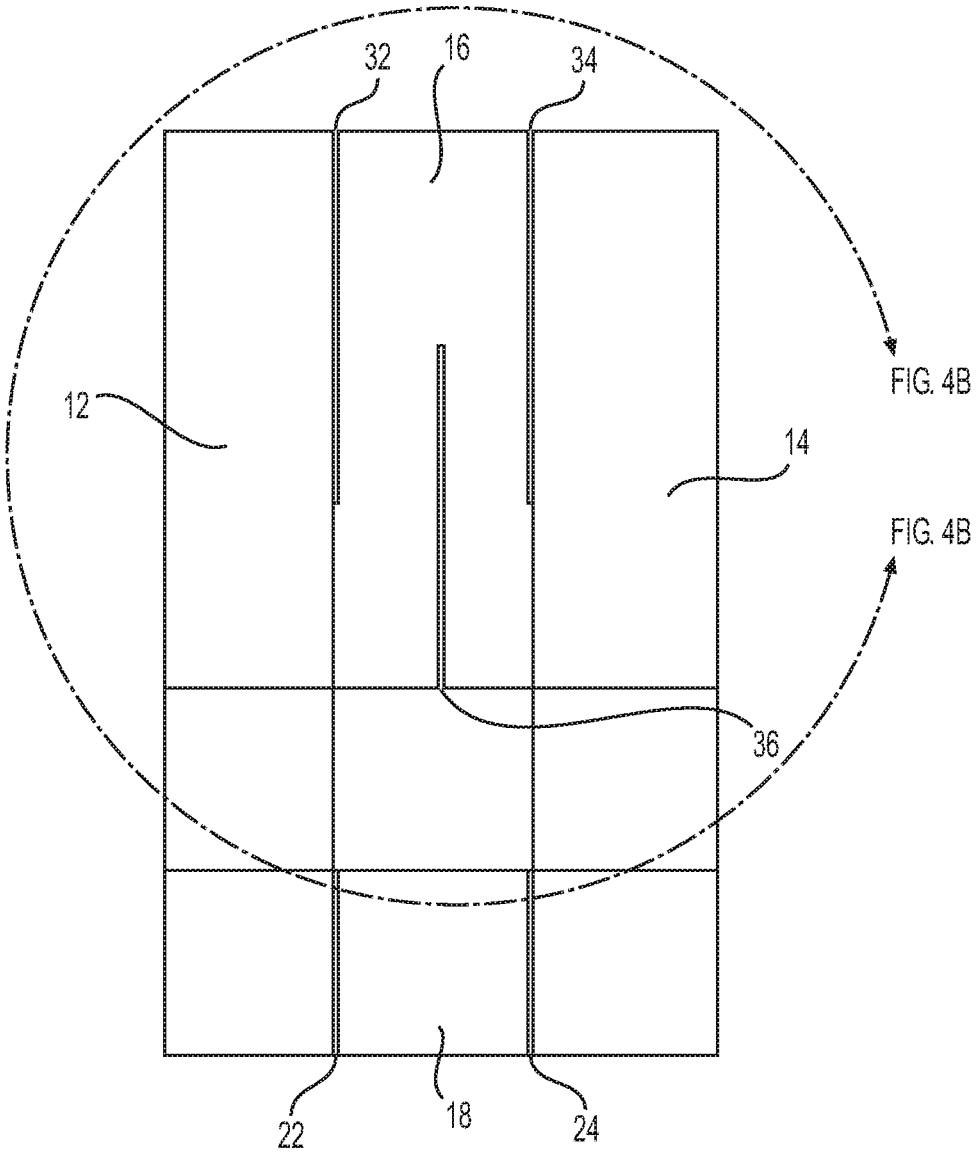
FIG. 4A is a front elevation view of the exemplary embodiment of the corner protector shown in FIGS. 1 and 2.
Figure 4B:
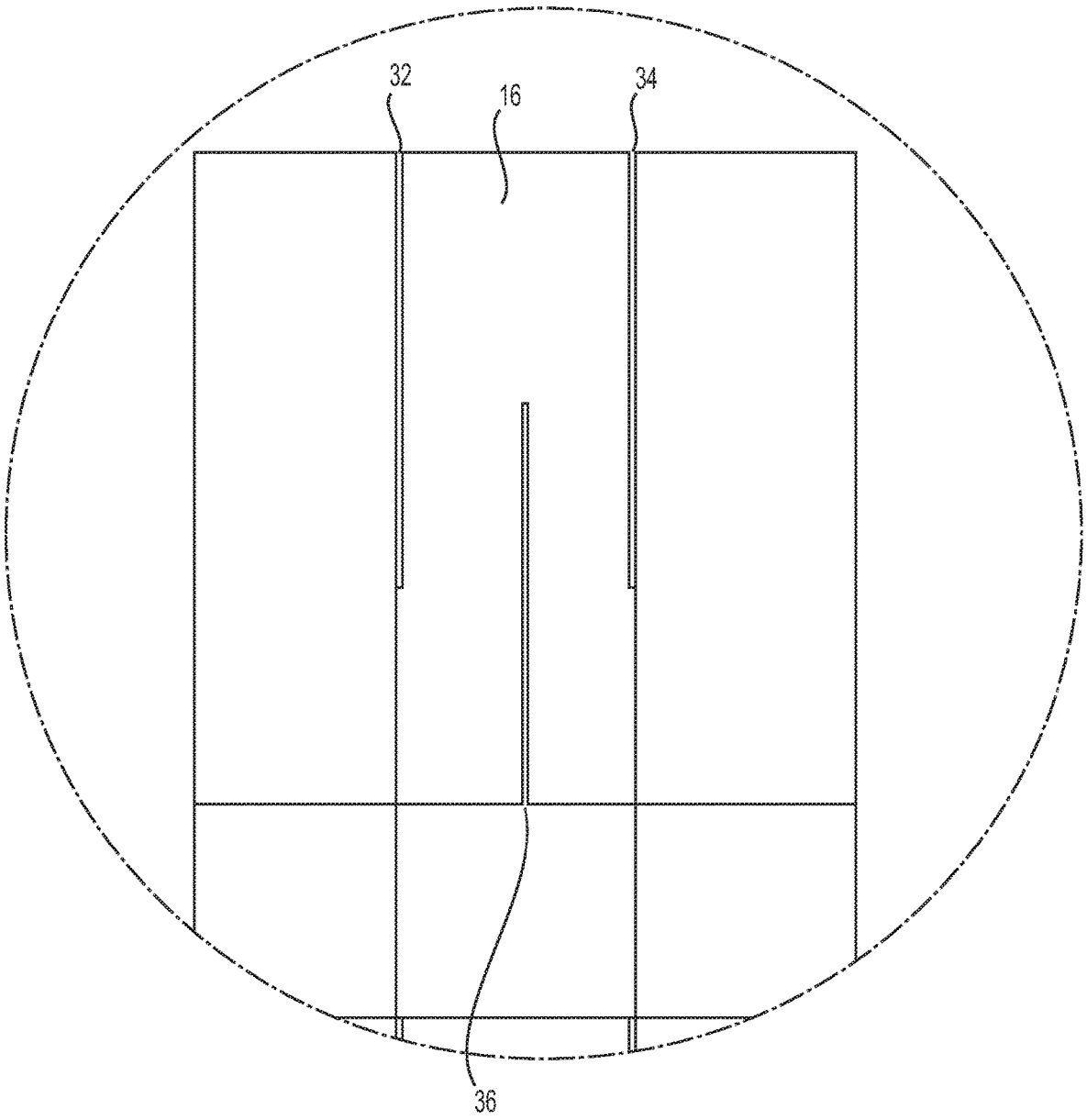
FIG. 4B is an enlarged view of a portion of FIG. 4A.
Figure 5:
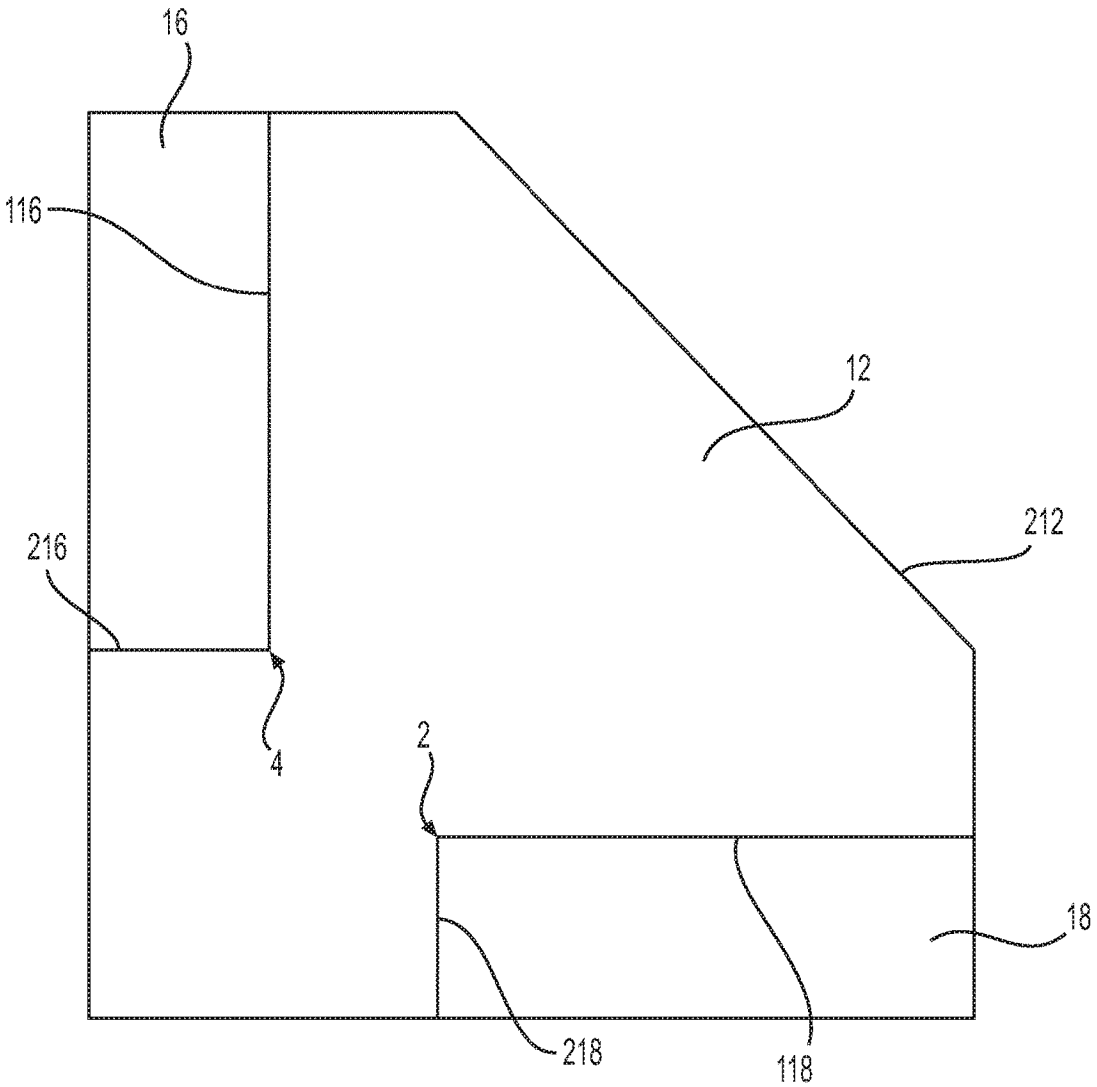
FIG. 5 is a side elevation view of the exemplary embodiment of the corner protector shown in FIGS. 1 and 2.

As shown in the exemplary embodiment of FIGS. 1 and 2, the corner protector 10 is configured for protecting a corner of an article in the shape of a rectangular solid. The corner protector 10 includes a first side panel 12 lying in a first plane, and a second side panel 14 lying in a second plane. As shown in the perspective views of FIGS. 1, 2, and 7, the top plan view of FIG. 3, and the front elevation views of FIGS. 4A and 4B, the exemplary corner protector 10 is configured to fit over the corner of an article in the shape of a rectangular solid. Therefore, the side panels 12 and 14 are substantially parallel to each other in order to contact, cushion, and protect portions of opposing, parallel side faces at each of the corners of the article configured in the shape of a rectangular solid. References in this specification to panels, surfaces, faces, planes, sides, cuts, or portions of an article, object, or exemplary corner protector being "substantially perpendicular" or "substantially parallel" to each other will be understood by one of ordinary skill in the art to encompass normal and customary manufacturing, molding, and assembling tolerances when working with typical packaging materials such as plastic foams, molded pulp, and other flexible, load-bearing, cushioning materials.

As further seen in the figures, the corner protector 10 also includes a first end panel 16, which is depicted as a back panel in the perspective views of FIGS. 1 and 2, and a second end panel 18, which is depicted as a bottom panel in the same views. The first and second end panels 16, 18 form an adjustable, accordion-like connection structure interconnecting the first side panel 12 and the second side panel 14 such that an inner surface 112 of the first side panel 12, and an inner surface 114 of the second side panel 14 define an adjustable article receiving cavity therebetween. As will be described in more detail below, the adjustable, accordion-like connection structure created by the first and second end panels 16, 18 is a result of multiple cuts or slits formed in the end panels that allow the end panels to expand and contract in a direction substantially perpendicular to the first and second interconnected side panels 12, 14. A number of factors may determine the direction or directions in which each of the end panels, and hence the adjustable, accordion-like connection structure is expandable and contractible. Factors determining the direction or directions in which the adjustable, accordion-like connection structure is expandable and contractible may include the thickness and size of the end panels, the resiliency and elasticity of the material from which the panels are fabricated, and the number, length, spacing, direction, and overlap of the cuts or slits in the end panels.

The accordion-like connection structure in the exemplary embodiment shown in the figures extends in between the first and second side panels 12, 14, and includes the first end panel 16 having a first side portion interconnected with the first side panel 12 and a second side portion interconnected with the second side panel 14. In the exemplary embodiment of the figures, the first and second side portions of the first and second end panels 16, 18 each extend along the entire length of opposite sides of the end panels. As best seen in the perspective views of FIGS. 1 and 2, a front surface 116 and a bottom surface 216 of each of the first and second side portions of the first end panel 16 interconnect with the first and second side panels 12, 14. Similarly, a back surface 218 and a top surface 118 of each of the first and second side portions of the second end panel 18 interconnect with the first and second side panels 12, 14. The first end panel 16 is arranged substantially perpendicular to the second end panel 18, and both the first and second end panels 16, 18 are arranged substantially perpendicular to the first and second side panels 12, 14.

Alternative embodiments may include other surfaces of the first and second side portions of the first and second end panels 16, 18 being interconnected with the first and second side panels 12, 14. For example, rather than receiving the first side portion of the first end panel 16 in a notched portion 4 of the first side panel 12, as seen in FIG. 2, the first side panel 12 may not have the notched portion 4, and the first side portion of the first end panel 16 may be interconnected with the first side panel 12 along the inner surface 112 of the first side panel 12, or along a back surface of the first side panel 12. Similarly, rather than receiving the second side portion of the first end panel 16 in a notched portion 8 of the second side panel 14, as seen in FIG. 1, the second side panel 14 may not have the notched portion 8, and the second side portion of the first end panel 16 may be interconnected with the second side panel 14 along the inner surface 114 of the second side panel 14, or along a back surface of the second side panel 14.

Further alternative embodiments of the corner protector 10 may not include notched portions in the first and second side panels 12, 14 for interconnecting with the second end panel 18, shown as a bottom panel in the exemplary embodiment of FIGS. 1 and 2. As with the alternative embodiments discussed above, rather than receiving the first side portion of the second end panel 18 in a notched portion 2 of the first side panel 12, as seen in FIG. 2, the first side panel 12 may not have the notched portion 2, and the first side portion of the second end panel 18 may be interconnected with the first side panel 12 along the inner surface 112 of the first side panel 12, or along a bottom surface of the first side panel 12. Similarly, rather than receiving the second side portion of the second end panel 18 in a notched portion 6 of the second side panel 14, as seen in FIG. 1, the second side panel 14 may not have the notched portion 6, and the second side portion of the second end panel 18 may be interconnected with the second side panel 14 along the inner surface 114 of the second side panel 14, or along a bottom surface of the second side panel 14. One of ordinary skill in the art will recognize that the geometric shapes and thicknesses of the first and second side panels 12, 14, and the first and second end panels 16, 18 may differ from those shown in the exemplary embodiment of the figures. Moreover, the interconnections between the first and second side panels and the first and second end panels may be different from those shown depending on various methods of joining the panels, materials used, manufacturability considerations, and economic factors. The shapes and thicknesses of the panels for the corner protectors may also be selected at least in part based on the fragility of a product being protected by the corner protector 10, cushion curve analysis for the chosen materials, and other customer or industry standards or requirements. In some alternative embodiments, additional thicknesses of any of the side panels and the end panels may be achieved by joining multiple identical panels together on top of each other.

The accordion-like connection structure created by the first and second end panels 16, 18 of the exemplary embodiment of the corner protector 10 may be achieved by both the first end panel 16 and the second end panel 18 including one or more cuts or slits in the respective end panels. In some exemplary embodiments, the cuts or slits may extend into the respective end panels from outer edges of third and fourth side portions between the first and second side portions of the respective end panels. Additionally, or in the alternative, at least one or more cuts or slits may be formed in central portions of one or more of the end panels between the outer edges of the one or more end panels and separated from the outer edges. These one or more central cuts may be positioned anywhere along the end panels between the side portions of the end panels that are interconnected with the side panels. As shown for the particular arrangement of the exemplary embodiment of the corner protector 10 depicted in the perspective views of FIGS. 1 and 2, spaced cuts or slits 32, 34 extend into the first end panel 16 from the outer edge of the third side portion that is along the top side of the first end panel 16 in FIGS. 1 and 2. The spaced cuts 32, 34 are located in between the side panels 12, 14. As further shown in the front elevation views of FIGS. 4A and 4B, a single cut or slit 36 extends into the first end panel 16 from the outer edge of the fourth side portion that is located along the bottom side of the first end panel 16 in FIGS. 4A and 4B. The cut 36 extends part way in between the two spaced cuts 32, 34 such that the cuts from opposite sides of the first end panel 16 are at least partially interlaced. This arrangement of cuts extending into the end panel from opposite sides of the end panel, and in between the side portions of the end panels that are interconnected with the first and second side panels 12, 14 allows the first end panel 16 to expand and contract in an accordion-like manner in a direction substantially perpendicular to the first and second side panels. In some embodiments, the cuts extending into the end panels from outer edges of the end panels, and/or the cuts formed in central portions of the end panels between the outer edges, may be substantially parallel to each other. In other embodiments, at least some of the cuts may be angled relative to each other in order to achieve a desired expansion of the opposite side panels. The angles of the cuts in the end panels, relative to each other and to outer edges of the panels may be a function of the shape of the article being protected and the dimensions of the outer package within which the article with installed corner protectors is packed. The number, length, spacing, direction, and overlap of the cuts or slits in the end panels may also determine, at least in part, the direction or directions in which each of the end panels, and hence the accordion-like connection structure is expandable and contractible.

As further shown for the particular arrangement of the exemplary embodiment of the corner protector 10 depicted in the perspective views of FIGS. 1 and 2, spaced cuts or slits 22, 24 extend into the second end panel 18 from the outer edge of the third side portion of the second end panel 18. As further shown in the top plan view of FIG. 3, a single cut or slit 26 extends into the second end panel 18 from the outer edge of the fourth side portion of the second end panel 18. The cut 26 extends part way in between the two spaced cuts 22, 24 such that the cuts from opposite sides of the second end panel 18 are at least partially interlaced. This arrangement of cuts extending into the second end panel 18 from opposite sides of the second end panel 18, and in between the side portions of the second end panel 18 that are interconnected with the first and second side panels 12, 14 allows the second end panel 18 to expand and contract in an accordion-like manner in a direction substantially perpendicular to the first and second side panels. The one or more cuts extending into the respective end panels 16, 18 from the outer edges of the third side portions of the respective end panels may be substantially parallel to and partially interlaced with the one or more cuts extending into the respective end panels 16, 18 from the outer edges of the fourth side portions of the respective end panels. Alternatively, one or more cuts in the end panels may be angled with respect to each other and with respect to outer edges of the panels. The angles of the cuts relative to the outer edges of the end panels may determine the relative orientations of the side panels when the corner protector is expanded, with the side panels moving to a relative orientation that is other than parallel for some implementations.

The exemplary embodiment of the corner protector 10 depicted in the figures only shows one cut extending in from the outer edge of one of the third side portion or the fourth side portion of each end panel 16, 18, and two cuts extending in from the outer edge of the other of the third side portion or the fourth side portion of each end panel 16, 18, with the one cut extending part way in between the two cuts. Alternative embodiments can include a greater number of interlaced cuts or slits extending into the first and second end panels depending at least in part on the thicknesses of the panels and the range of thicknesses of articles over which the corner protector 10 may be installed. The extent by which the cuts extending into an end panel from one side of the end panel may overlap with the cuts extending into the end panel from an opposite side of the end panel may be determined as a function of the thickness of the panel, the material from which the panel is formed, and the range of distances over which the side panels 12, 14 may need to be spaced from each other when installed over an article 60. The structural characteristics of the material from which the panels are formed may also be a factor in determining the length of the interlaced cuts, and how close each of the cuts may come to the opposite side of the panel without risking tearing of the panels as they are expanded and contracted to fit over articles of differing thicknesses.

In the exemplary corner protector 10 depicted in the figures, the first and second side portions of at least one of the first and second end panels 16, 18 are received in notched portions defined along outer edges of the first and second side panels 12, 14, respectively. As seen in the perspective view of FIG. 1, a right-hand side portion of the first end panel 16 is received in a notched portion 8 of the second side panel 14. The notched portion 8 may assist with the alignment, assembly, and interconnection of the first end panel with the second side panel 14. Additionally, notched portions 2, 4, 6, 8 in the first and second side panels 12, 14, as seen in FIGS. 1, 2, 5, 6, and 7, position the first and second end panels 16, 18 relative to the first and second side panels 12, 14, and relative to each other such that a void 50 is defined at an outside corner of the corner protector 10 between corners of the side panels 12, 14 and end surfaces 216, 218 of the end panels 16, 18, respectively. The void 50, best seen in FIG. 7, creates a standoff distance between the outer corner of an article positioned between the first and second side panels 12, 14 of the corner protector 10 and the interior surface of an outer package within which the article with corner protectors at each corner is installed. The standoff distance between a corner of an article protected by the disclosed corner protector 10 and an outside package allows each of the corners to essentially float, or be held in suspension at a distance from the outside package, thereby creating a crush zone at each corner of the article. As shown in FIG. 1, and discussed above, the notched portion 8 of the second side panel 14 allows interconnection of the first end panel 16 to the second side panel 14 along two orthogonal surfaces 116, 216. The increased amount of surface area over which the end panels and side panels may be joined may also enhance the strength of the corner protector 10. Similarly, the notched portion 4 of the first side panel 12 allows interconnection of the first end panel 16 to the first side panel 12 along two orthogonal surfaces 116, 216, and the notched portions 2, 6 in the first and second side panels 12, 14, respectively, allow interconnection of the second end panel 18 to the first and second side panels 12, 14 along two orthogonal surfaces 118, 218.

The notched portions 2, 4, 6, 8 of the first and second side panels are defined along the outer edges of two sides of the respective side panels at distal ends of the two sides opposite from a corner region formed by intersecting proximal ends of the two sides. As shown in the perspective views of FIGS. 1 and 2, the disclosed exemplary embodiment of the corner protector 10 includes the substantially parallel first and second side panels 12, 14 having a partially truncated triangular configuration, with angular faces 212, 214 extending between sides of the side panels adjacent the distal ends of the sides with the notched portions. In this particular embodiment, the angular faces 212, 214 of the first and second side panels 12, 14 truncate one corner of the corner protector 10. As discussed above, alternative embodiments of the corner protector 10 may include the side panels and the end panels having different configurations depending on specific needs of a customer for the types and shapes of articles being protected and the fragility of the articles.

As best seen in FIG. 7, the void 50 is formed in a region extending between the corner regions formed by the intersecting proximal ends of the two sides of each of the first and second side panels 12, 14 along which the notched portions 2, 4, 6, 8 are formed. The void 50 is also defined between the end surfaces 216, 218 of end panels 16, 18, respectively, as a result of the right-hand and left-hand side portions of the end panels being positioned in the notched portions 2, 4, 6, 8 of the side panels. The void 50 may create a crush zone at each corner of an article protected by the disclosed exemplary embodiment of the corner protector 10. As discussed above, the void 50 provides a space between the outer corner of an article with the corner protector 10 installed and an inner surface of an outer package within which the article and corner protectors 10 are installed. The standoff distance created by the void 50 at the outside corner of each corner protector 10 ensures that forces of an impact at each corner of the protected article will not be transferred directly to the article, and the corner protectors will create a suspension effect for the protected article.

In some exemplary embodiments of the corner protector 10 according to this disclosure, the first and second side panels 12, 14, and the first and second end panels 16, 18 may be formed as separate panels from a flexible, load-bearing, plastic foam. Examples of the flexible, load-bearing, plastic foam materials may include polyethylene and polyurethane. The selected flexible and load-bearing materials may be characterized by a resiliency and elasticity that allows the materials to absorb impact forces, and also spring back to their original configurations after the impact. Additionally, the resiliency of the selected materials allows the connection structure created by the end panels with cuts or slits for an accordion-like expansion of the distance between the two side panels of the corner protector to continue to return to its original configuration when removed from a corner of a protected article. The resiliency of the selected material may allow the corner protector to generate an inward grasping force on the opposite sides of the article at each corner such that the corner protectors are retained on each corner as the protected article is installed into an outer package. Other materials such as recycled paper pulp materials are also contemplated and will fall within the scope of the appended claims. Depending on the materials selected, in some exemplary embodiments the first and second end panels 16, 18 may be joined at their first and second side portions to the first and second side panels 12, 14, respectively, using an adhesive or some type of a welding process. Some methods of joining the panels using adhesives, by way of example only, may include application of a hot-melt type adhesive, or a spray adhesive. Furthermore, some methods of joining the panels made from materials such as thermoplastics using a welding process, by way of example only, may include a heat welding process, where heat and pressure may be applied by hand or by using a thermal assembly machine, a thermal welding process such as spin welding, where friction or heat may be produced by spinning the parts, an ultrasonic welding process, using high frequency acoustic vibrations, and a vibration welding process, where the parts to be joined are rubbed together at certain frequencies and amplitudes. Various methods that may be implemented for forming and interconnecting the side panels 12, 14 and the end panels 16, 18 of the disclosed corner protector 10 will be discussed in more detail in the following section.

INDUSTRIAL APPLICABILITY

The corner protector 10 according to various exemplary embodiments of this disclosure provides a high performance and universally applicable solution for a protective packaging structure. The disclosed embodiments simplify and expedite the packaging process for a large variety of different sized articles. The configuration of the disclosed corner protector that enables the corner protector to engage with two opposing faces of articles of differing thicknesses at each of the corners of the articles makes the application of the packaging structure more efficient than traditional corner protectors that only engage two corner end surfaces and one of the side faces of the article. The disclosed configurations of the exemplary corner protector also cut in half the number of corner protectors needed for protecting an article as compared to the traditional three-sided corner protectors. The article with the four corner protectors attached can be readily inserted in a shipping container. As a result, the various disclosed embodiments of a packaging structure provide a universal solution that can be used on a large variety of different sized articles and packages, thereby creating economies of scale and significant cost savings. The disclosed embodiments can also be re-used for multiple shipping cycles of different articles, creating advantages in the sustainability of resources. The disclosed embodiments also can be made from recyclable materials or 100% virgin materials for additional environmental benefits.

The disclosed exemplary embodiment of the expandable corner protector 10 also provides a void region 50 at the outside corner, such that the corner of the article 60 held within the corner protector 10 is spaced from inner surfaces of an outer shipping container surrounding the article with corner protectors according to this disclosure installed on each corner of the article. When an article with each of four corners covered by one of the corner protectors of the present disclosure is then fit within the outer shipping container, forces that might be applied during shipping to the corners of the shipping container and the corner protectors are not transferred to the corners of the article. The disclosed exemplary embodiments of a corner protector thus provide a suspension effect for extra protection at the corners of the articles to be shipped. Referring to FIG. 7, the void 50 creates a standoff distance between the corner of the article 60 and outside surfaces of the corner protector. Therefore, forces exerted on an outer shipping container within which the article 60 and corner protectors are installed would only be transferred through one or more of the side panels 12, 14, and end panels 16, 18, and along the flat outer side surfaces and/or end surfaces of the article 60, with no direct transfer of the forces to the corners of the article.

A packaging structure according to various embodiments of this disclosure can be inserted between an outside corner of an article and a shipping container. The packaging structure may include a first side panel lying in a first plane, a second side panel lying in a second plane parallel to the first plane, a first end panel lying in a third plane perpendicular to the first and second planes, and a second end panel lying in a fourth plane perpendicular to the first, second, and third planes. The first end panel may have a first side portion interconnected with the first side panel and a second side portion interconnected with the second side panel. The second end panel may have a first side portion interconnected with the first side panel and a second side portion interconnected with the second side panel. Both the first end panel and the second end panel may include one or more cuts extending into the respective end panels from outer edges of third and fourth side portions between the first and second side portions of the respective end panels. The cuts allow the end panels to expand and contract in an accordion-like manner in a direction substantially perpendicular to the first and second side panels. Inner surfaces of the first and second side panels and inner surfaces of the first and second end panels together define an adjustable cavity for receiving the outside corner of the article.

One exemplary implementation of a method for fabricating a corner protector 10 for protecting a corner of an article 60 is described below. Although the described method, and the above-described structure includes interconnected first and second end panels and first and second side panels, alternative implementations may include forming the corner protector 10 by molding, additive manufacturing such as 3D printing, or other fabrication processes for forming alternative embodiments of the corner protector 10 as a single piece or as fewer or a greater number of pieces than the disclosed four panels.

Figure 6:
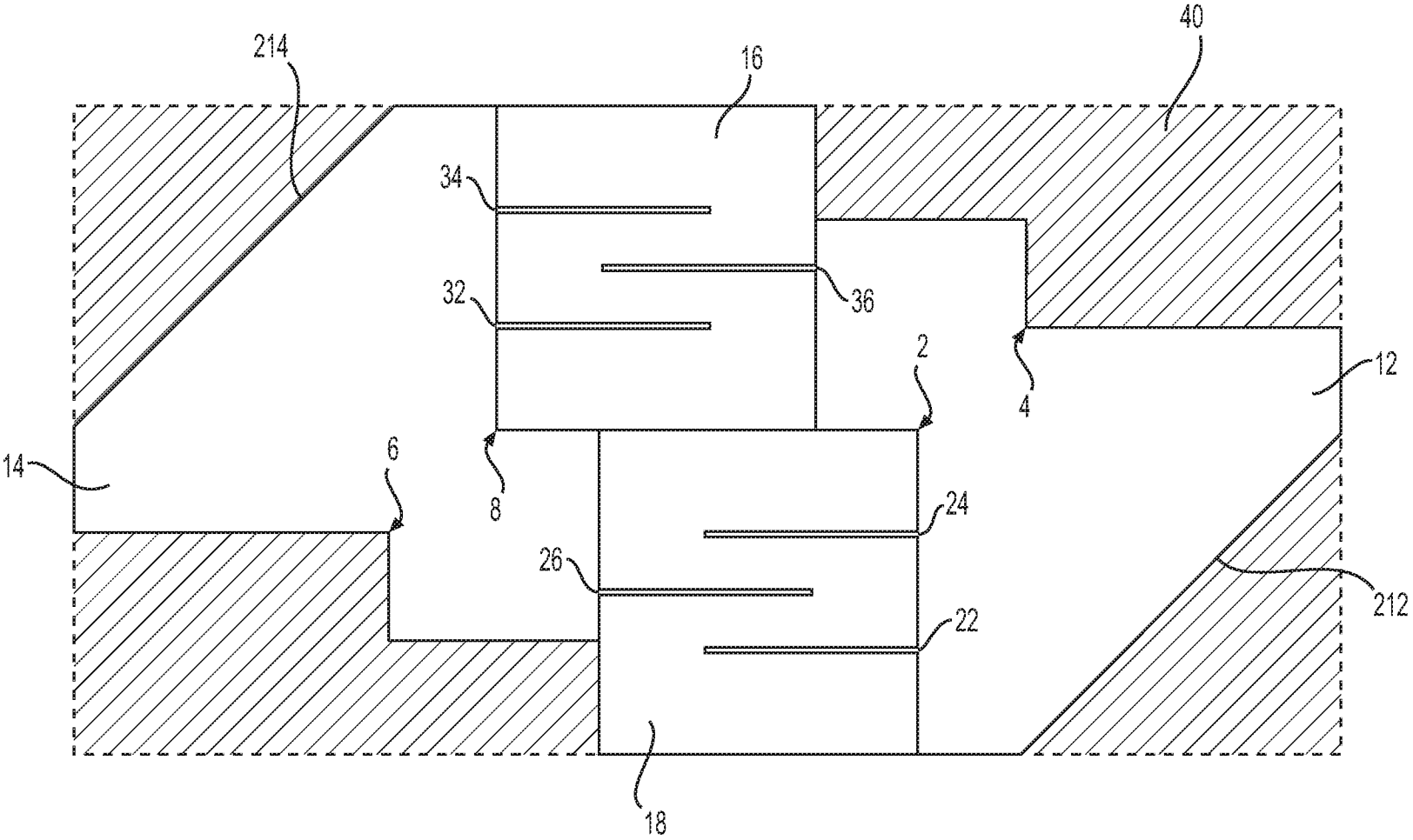
FIG. 6 is a schematic plan view of a template for cutting the four pieces of the exemplary embodiment of the corner protector shown in FIGS. 1 and 2 from a piece of material.

One exemplary method for forming the disclosed exemplary embodiment of the corner protector 10 includes forming the first and second side panels 12, 14, and the first and second end panels 16, 18 from a flexible, load-bearing plastic foam. As shown in FIG. 6, the four panels may all be cut from a single piece of the plastic foam 40, or the panels may be cut from multiple separate pieces of the foam. In one exemplary implementation, a die stamp machine may be used to simultaneously stamp out all four panels from a single piece of plastic foam 40. The cuts or slits 32, 34, 36, in the first end panel 16, and the cuts or slits 22, 24, 26, in the second end panel 18 may be formed during the die stamping process. In alternative embodiments, the cuts or slits may be formed in the end panels after the end panels are joined to the side panels to form the assembled corner protector 10. However, ease of manufacturing may dictate forming the cuts before assembling the separate panels.

As shown in FIG. 6, one or more cuts or slits 32, 34, 36 may be formed to extend into the first end panel 16 and one or more cuts or slits 22, 24, 26 may be formed to extend into the second end panel 18 from outer peripheral edges of first and second opposite and parallel side portions of the end panels. The cuts or slits are configured to allow the end panels to expand and contract in an accordion-like manner in a direction substantially parallel to the outer peripheral edges of the first and second side portions. Some alternative implementations may also include forming at least one slit along a portion of the end panels in between the outer peripheral edges. As discussed above, the resiliency and elasticity of the materials from which the end panels 16, 18 are fabricated allows the end panels to expand to fit over the corner of an article, and then return to their original configuration when the corner protector is removed from the article. The characteristics of the materials from which the end panels are fabricated and additional factors such as the number, length, spacing, direction, and overlap of the cuts or slits in the end panels, also may allow each of the end panels, and hence the accordion-like connection structure to expand and contract in an accordion-like manner in one or more directions that may deviate from substantially parallel to the outer peripheral edges of the first and second side portions, and from substantially perpendicular to the side panels.

As further shown in FIG. 6, the first side panel 12 may be stamped out of the piece of foam 40 with the notched portions 2 and 4 defined along the outer edges of two sides of the first side panel at distal ends of the two sides opposite from a corner region formed by intersecting proximal ends of the two sides. The second end panel 18 may be stamped out of the piece of foam 40 to overlap with and include the material removed from the notched portion 2 of the first side panel 12. Similarly, the second side panel 14 may be stamped out of the piece of foam 40 with the notched portions 6 and 8 defined along the outer edges of the two sides of the second side panel 14 at distal ends of the two sides opposite from a corner region formed by intersecting proximal ends of the two sides. The first end panel 16 may be stamped out of the piece of foam 40 to overlap with and include the material removed from the notched portion 8 of the second side panel 14. The exemplary arrangement of the first and second end panels 16, 18, and first and second side panels 12, 14 on the piece of foam 40, as shown in FIG. 6, maximizes the amount of material used and minimizes waste. Alternative implementations may include other arrangements of the panels on a piece of foam for die stamping, and as discussed above, the shapes of the panels may differ depending on the shapes of the particular articles to be protected, the fragility of the articles, and the cushioning characteristics of the particular packaging material from which the panels are fabricated. The thicknesses of the panels 12, 14, 16, 18, and the presence and/or size of notched portions 2, 4, 6, 8, in the side panels 12, 14, also determines the size and shape of any void 50 formed between the side panels 12, 14, and the end surfaces 216, 218 of the end panels 16, 18 when the panels have been assembled into the finished corner protector 10.

After the four separate panels have been cut out from the piece of foam 40, the panels may be joined together using any of a variety of methods such as those discussed above. Exemplary methods may include the application of hot melt adhesives, spray adhesives, and various welding processes. By way of example only, a heat welding process may include application of heat using a heat gun for a few seconds to the surfaces of the panels that will be joined, and then pressing the two surfaces together and maintaining the pressure for an additional few seconds. With the cuts or slits 32, 34, 36 already formed in the first and second opposite and parallel side portions of the first end panel 16, and/or a central portion of the end panel in between the side portions, a third side portion of the first end panel 16 is interconnected with the first side panel 12, and a fourth side portion of the first end panel 16 is interconnected with the second side panel 14 such that the first end panel 16 is arranged substantially perpendicular to the first and second side panels. As discussed above, the third and fourth side portions of the first end panel 16 may be received in the notched portions 4 and 8, respectively, of the first and second side panels 12, 14.

Similarly, with the cuts or slits 22, 24, 26 already formed in the first and second opposite and parallel side portions of the second end panel 18, and/or a central portion of the end panel in between the side portions, a third side portion of the second end panel 18 is interconnected with the first side panel 12, and a fourth side portion of the second end panel 18 is interconnected with the second side panel 14 such that the second end panel 18 is arranged substantially perpendicular to the first and second side panels 12, 14. As discussed above, the third and fourth side portions of the second end panel 18 may be received in the notched portions 2 and 6, respectively, of the first and second side panels 12, 14. The first and second end panels 16, 18 are joined to the first and second side panels 12, 14 such that the cuts or slits in the end panels are positioned in between the substantially parallel side panels 12, 14, and the cuts or slits allow for the expansion and contraction of the distance between the side panels to accommodate articles of different thicknesses. The inner surfaces 112, 114 of the first and second side panels 12, 14, and inner surfaces of the first and second end panels 16, 18 together define a cavity with an adjustable distance between the inner surfaces 112, 114 of the first and second side panels 12, 14 for receiving the corners of articles having different thicknesses. End surfaces of the first and second end panels 16, 18 are spaced from each other on sides of the void 50 defined between the corner regions at the intersecting proximal ends of the notched sides of the first and second side panels 12, 14. This arrangement of the end panels at spaced distances from the outer corners of the side panels can also be maintained during assembly of the corner protector 10 even when the side panels are not provided with notched portions to assist in the assembly and spacing of the end panels. As discussed above, the void 50 defined between the inside surfaces of the outer corners of the side panels and the end surfaces of the end panels provides a crush zone at the corner of the corner protector 10, with the corners of an article 60 protected by the disclosed corner protectors being suspended at a distance from the inner corners of an outer shipping container for an extra layer of protection. The first and second side panels 12, 14 may form protective outer corner regions on both sides of the void 50, and the accordion-like connection structure formed by the end panels 16, 18 is spaced inwardly from the outer protective corner regions, thereby forming the void 50 between the accordion-like connection structure and the protective corner regions of the side panels.

It will be apparent to those skilled in the art that various modifications and variations can be made to the structure and methodology described herein. Thus, it should be understood that the invention is not limited to the subject matter discussed in the specification. Rather, the present invention is intended to cover modifications and variations that fall within the scope of the claims.

What is claimed is:

1. A corner protector for protecting a corner of an article, the corner protector comprising:

a first side panel lying in a first plane and having a first uniform thickness over an entire extent of the first side panel including outer edges of the first side panel;

a second side panel lying in a second plane and having a second uniform thickness over an entire extent of the second side panel including outer edges of the second side panel; and an adjustable connection structure interconnecting the first side panel and the second side panel and being expandable and contractible, such that inner surfaces of the first and second side panels define an adjustable corner receiving cavity therebetween, wherein the adjustable connection structure comprises a pair of end panels that are separate and distinct from each other and that are spaced from each other, each of the end panels being received in notched portions defined along the outer edges of the first and second side panels with the notched portions being spaced from outside corners of the first and second side panels to form a void between the outside corners of the first and second side panels and end surfaces of the end panels, and each of the end panels extending into each of the first and second side panels from the respective outer edges of the first and second side panels by a distance at least equal to the respective first and second uniform thicknesses of the first and second side panels.

2. The corner protector of claim 1, wherein the first and second side panels are parallel to each other and the adjustable connection structure is an accordion-like connection structure that expands and contracts in an accordion-like manner in a direction perpendicular to the first and second side panels.

3. The corner protector of claim 2, wherein the first and second side panels and the accordion-like connection structure are formed from a flexible, load-bearing, plastic foam.

4. The corner protector of claim 3, wherein the first and second side panels and the accordion-like connection structure are formed from one of polyethylene or polyurethane foam.

5. A method of protecting an article having a generally rectangular shape, the method comprising applying to each of the four corners of the article a corner protector of claim 2.

6. The method of claim 5, further including placing the article with the corner protectors into a box sized to snugly accept the article with the corner protectors applied to the article.

7. The method of claim 6, wherein the only structures between the article and the box are the four corner protectors.

8. A corner protector for protecting a corner of an article, the corner protector comprising:

a first side panel lying in a first plane and having a first uniform thickness over an entire extent of the first side panel including outer edges of the first side panel;

a second side panel lying in a second plane and having a second uniform thickness over an entire extent of the second side panel including outer edges of the second side panel; and an accordion-like connection structure interconnecting the first side panel and the second side panel and being expandable and contractible such that inner surfaces of the first and second side panels define an adjustable article receiving cavity therebetween, wherein the accordion-like connection structure comprises a pair of end panels that are separate and distinct from each other and that are spaced from each other, each of the end panels being received in notched portions defined along the outer edges of the first and second side panels with the notched portions being spaced from outside corners of the first and second side panels to form a void between the outside corners of the first and second side panels and end surfaces of the end panels, and each of the end panels extending into each of the first and second side panels from the respective outer edges of the first and second side panels by a distance at least equal to the respective first and second uniform thicknesses of the first and second side panels.

9. The corner protector of claim 8, wherein the pair of end panels includes:

a first end panel having a first side portion interconnected with the first side panel and a second side portion interconnected with the second side panel; and a second end panel arranged perpendicular to the first end panel and having a first side portion interconnected with the first side panel and a second side portion interconnected with the second side panel, wherein both the first end panel and the second end panel include one or more cuts extending into the respective end panels from outer edges of third and fourth side portions between the first and second side portions of the respective end panels to allow the end panels to expand and contract in an accordion-like manner in a direction perpendicular to the first and second side panels.

10. The corner protector of claim 9, wherein the one or more cuts extending into the respective end panels from the outer edges of the third side portions of the respective end panels are parallel to and partially interlaced with the one or more cuts extending into the respective end panels from the outer edges of the fourth side portions of the respective end panels.

11. The corner protector of claim 10, wherein the one or more cuts extending into each of the respective end panels include one cut extending in from the outer edge of one of the third side portion or the fourth side portion, and two cuts extending in from the outer edge of the other of the third side portion or the fourth side portion, with the one cut extending part way in between the two cuts.

12. The corner protector of claim 9, wherein the first and second side panels and the first and second end panels are formed as separate panels from a flexible, load-bearing, plastic foam, and wherein the first and second end panels are joined at their first and second side portions to the first and second side panels, respectively, using one of an adhesive, or a heat welding process.

13. The corner protector of claim 9, wherein the first and second end panels and the first and second side panels are formed from one of polyethylene or polyurethane foam.

14. A packaging structure for insertion between an outside corner of an article and a shipping container, the packaging structure comprising:

a first side panel lying in a first plane and having a first uniform thickness over an entire extent of the first side panel including outer edges of the first side panel;

a second side panel lying in a second plane parallel to the first plane and having a second uniform thickness over an entire extent of the second side panel including outer edges of the second side panel;

a first end panel lying in a third plane perpendicular to the first and second planes, the first end panel having a first side portion interconnected with the first side panel and a second side portion interconnected with the second side panel; and a second end panel that is separate and distinct from the first end panel and spaced from the first end panel, the second end panel lying in a fourth plane perpendicular to the first, second, and third planes, the second end panel having a first side portion interconnected with the first side panel and a second side portion interconnected with the second side panel, wherein the first and second end panels are each received in notched portions defined along the outer edges of the first and second side panels and each extending into each of the first and second side panels from the respective outer edges of the first and second side panels by a distance at least equal to the respective first and second uniform thicknesses of the first and second side panels, with the notched portions being spaced from outside corners of the first and second side panels to form a void between the outside corners of the first and second side panels and end surfaces of the end panels, and both the first end panel and the second end panel include one or more cuts extending into the respective end panels from outer edges of third and fourth side portions between the first and second side portions of the respective end panels to allow the end panels to expand and contract in an accordion-like manner in a direction perpendicular to the first and second side panels, and wherein inner surfaces of the first and second side panels and inner surfaces of the first and second end panels together define an adjustable cavity for receiving the outside corner of the article.

15. The packaging structure of claim 14, wherein the one or more cuts extending into the respective end panels from the outer edges of the third side portions of the respective end panels are parallel to and partially interlaced with the one or more cuts extending into the respective end panels from the outer edges of the fourth side portions of the respective end panels.

16. The packaging structure of claim 14, wherein the one or more cuts extending into each of the respective end panels include one cut extending in from the outer edge of one of the third side portion or the fourth side portion, and two cuts extending in from the outer edge of the other of the third side portion or the fourth side portion, with the one cut extending part way in between the two cuts.

17. The packaging structure of claim 14, wherein the first and second side panels and the first and second end panels are formed as separate panels from a flexible, load-bearing, plastic foam, and wherein the first and second end panels are joined at their first and second side portions to the first and second side panels, respectively, using one of an adhesive, or a heat welding process.

18. The packaging structure of claim 14, wherein the first and second side panels and the first and second end panels are formed from one of polyethylene or polyurethane foam.

* * * * *